US005609522A

United States Patent [19]

Szwartz

[11] Patent Number: 5,609,522

[45] Date of Patent: Mar. 11, 1997

[54] COMBINATION DAMPER AND CHIMNEY CAP APPARATUS

[76] Inventor: Henry S. Szwartz, 17 Terrace Ave., P.O. Box 123, Suffern, N.Y. 10901

[21] Appl. No.: 374,038

[22] Filed: Jan. 18, 1995

[51] Int. Cl.[6] ..... F23L 17/02

[52] U.S. Cl. ..... 454/7; 110/162; 110/163; 126/285 B; 454/13; 454/16

[58] Field of Search ..... 454/3, 5, 7, 13, 454/16, 30, 35; 126/286, 285 B; 110/162, 163

[56] References Cited

U.S. PATENT DOCUMENTS

| | | | |
|---|---|---|---|
| 2,171,883 | 9/1939 | McDermont . | |
| 2,295,839 | 9/1942 | Grigsby . | |
| 2,407,590 | 9/1946 | Vineberg . | |
| 2,564,971 | 8/1951 | Harding . | |
| 2,632,376 | 3/1953 | Driscoll | 454/13 |
| 2,713,301 | 7/1955 | McKann | 454/16 |
| 3,012,495 | 12/1961 | Miller . | |
| 3,829,010 | 8/1974 | Jones . | |
| 3,945,307 | 3/1976 | Lyemance . | |
| 3,996,920 | 12/1976 | Andrews . | |
| 4,027,655 | 6/1977 | Feldl . | |
| 4,106,693 | 8/1978 | Oliver . | |
| 4,143,817 | 3/1979 | Oliver . | |
| 4,165,679 | 8/1979 | Lyemance . | |
| 4,235,219 | 11/1980 | DeFoe . | |
| 4,273,097 | 6/1981 | Szwartz . | |
| 4,501,389 | 2/1985 | Kolt . | |
| 4,554,863 | 11/1985 | Dalsin . | |
| 4,649,808 | 3/1987 | Ward et al. . | |
| 4,846,400 | 7/1989 | Crouse | 126/285 B X |
| 4,858,517 | 8/1989 | Coker . | |
| 5,123,875 | 6/1992 | Eubank et al. . | |

FOREIGN PATENT DOCUMENTS

| | | | |
|---|---|---|---|
| 2376935 | 8/1978 | France . | |
| 2478268 | 9/1981 | France | 126/285 B |
| 2505457 | 11/1982 | France . | |
| 530 | of 1892 | United Kingdom | 454/4 |

OTHER PUBLICATIONS

Lyemance International Publication Brochure, Jeffersonville, Indiana, Printed in U.S.A., 4 sheets.

*Primary Examiner*—Harold Joyce
*Attorney, Agent, or Firm*—Weingram & Assocs.

[57] ABSTRACT

A combination damper and chimney cap apparatus is provided to ventilate a fireplace and a flue connected thereto to provide a draft through the flue. The apparatus includes a platform constructed and arranged to be removably mounted to the flue and formed with an aperture extending therethrough in communication with the flue. An element senses temperature-smoke at the flue and at an area external to a fireplace connected to the flue to provide a signal in response to the temperature-smoke. A ventilation fan is connected to the a support to provide a draft sufficient to exhaust the smoke from the fireplace and the flue and to cool a electronic motor for the apparatus.

16 Claims, 3 Drawing Sheets

COMBINATION DAMPER AND CHIMNEY CAP APPARATUS

BACKGROUND OF THE INVENTION

1. Field of the Invention

The present invention relates to apparatus that control draft conditions in a fireplace and through a chimney flue, and particularly, to apparatus which are removably mountable to the chimney or a chimney cap.

2. Description of the Related Art

Damper apparatus are used with ventilation systems, fire box heating systems and chimney flues. Such apparatus usually require substantial effort to be installed and maintained for operation due to their complexity. In addition, these apparatus are not constructed to be removably mountable without altering the structure of the supporting object to which they are mounted.

For example, a ventilation system is disclosed in U.S. Pat. No. 2,171,883 to McDerment, where a rotary ventilator consisting of a fan and motor is supported within a roof coaming. A hood-like rotary cowl member is disposed over the fan and includes louvers arranged for pivotal movement. The louvers are connected to a lever which in turn is controlled by a cable member.

U.S. Pat. No. 2,564,971 to Harding, discloses means for reducing fire danger in hotels and consists of ports leading from a room to a duct formed by a false ceiling in the top of a hallway, each duct opening to a stack in which is disposed a power driven fan for cooling and ventilating. A curved baffle is provided where two aligned ports occur in opposed wall partitions to guide the draft from a room into the duct and to direct flame from a room into the duct toward the stack. The damper is automatically closed by a temperature sensitive link or a thermostatically expansible bellows.

U.S. Pat. No. 3,012,495 to Miller, discloses a combined air dampener and air diverter which consists of an inverted cone adapted to normally remain at rest atop an air stack where it is lifted to a raised position by the movement of air alone in the stack to a position abutting the underside of a dome which is spaced from the upper end of the stack. The conical shape is an air diverter when raised. A fan in the stack forces air upwardly through the stack which results in the inverted cone being moved to the raised position. When the fan ceases to rotate, the cone will rest as a damper and seal the upper end of the stack from the outside air.

U.S. Pat. No. 3,829,010 to Jones, discloses a thermostat for power ventilators which senses temperature level while a fan driven by an electric motor positioned in an opening of the roof blows air from the closed space to the exterior. When the closed space air temperature decreases to a certain level, the thermostat switches the power ventilator off in response to this temperature level.

U.S. Pat. No. 4,501,389 to Kolt, discloses an automatic damper assembly for ventilating systems and includes a conduit mounted to a roof with a wind driven turbine assembly or a fan mounted to an upper end of the conduit in which is disposed a pair of vanes. A motor is mounted to the top of the turbine. A temperature responsive drive assembly is disposed in the conduit to detect the conduit temperature and regulate opening and closing of the vanes in the air passageway of the conduit.

U.S. Pat. No. 5,123,875 to Eubank, et al., discloses a power actuated roof vent apparatus which consists of an air passageway housing through the roof of an enclosed area and a lid which closes the airflow therethrough. A power actuated fan assembly is positioned within the air passageway housing and is driven by a motor which can also be disposed within the air passageway housing. A switch controls the drive motor to open or close the passageway closure lid with the fan being actuated depending upon the position of the closure lid. A heat sensor and/or smoke detector may be incorporated within the switching system to close the lid during a fire.

Fireplace heating systems which employ damper elements are disclosed in the following patents.

U.S. Pat. No. 2,407,590 to Vineberg, discloses a heating apparatus which consists of a fire box, a flue connected thereto and a smoke condenser which interrupts the flue to permit an exchange of heat between the air and combustion products. The flue extends from the condenser to a fan which is driven by a motor for creating a forced draft from the firebox through the flue to discharge the smoke out-of-doors. Dampers are provided in the flue and may be electrically operated under the control of the speed of the fan motor. An electromagnetic device, such as a solenoid, is disposed at the fire box to automatically control a gate closing at the fire box to prevent smoke from entering the room. A fan draws air in at an inlet in front of the heater and beneath the fire box to pass cooling air over the motor.

U.S. Pat. No. 4,106,693 to Oliver, discloses an automatic fireplace heating system which consists of a fireplace, combustion zone, flue and damper for opening and closing the passageway from the combustion zone to the flue, the flue being divided into two parallel independent flue passages, one of which contains a heat exchanger adapted to absorb the heat from hot gases passing through the flue into air circulating inside the heat exchanger. A movable diverter directs the hot gases into either parallel flue or into both in desired proportions. A fan circulates the air from the heat exchanger. Thermostats sense the heat and the space to be heated to cause a solenoid to move the diverter to open or close the flue to any partial opening.

U.S. Pat. No. 4,143,817 to Oliver, discloses an automatic fireplace heating system which includes parallel flue passageways one of which is provided with a heat exchanger. A diverter is employed to divert flue gases into either or both the flue passages. A temperature sensing means is disposed in the heat exchanger flue passageway and a room thermostat temperature sensing means is also provided at an external room location.

Patents which disclose control mechanisms for fireplace dampers include U.S. Pat. No. 2,295,839 to Grigsby, where a chimney damper is installed at the top of the chimney. The damper consists of a shell open at its upper and lower ends and having a cross-shaft therein with its ends journaled in openings of opposed sidewalls of the shell. A damper plate is secured to the shaft to be moved between open and close positions by a chain connected thereto. The chain extends down the chimney to a weight which regulates the open and close position of the damper plate. A foraminous dome mounted to a flange at the outer end of the shell serves to break up sparks and prevent insects from entering the chimney.

U.S. Pat. No. 4,027,655 to Feldl, discloses a fireplace damper release mechanism which is adapted to automatically close the fireplace damper when the fire has gone out thereby avoiding loss of heat from the room to the fireplace chimney area. The mechanism includes a housing for receiving a vertical lower end portion of a fireplace damper connecting rod, which rod includes an upper end portion attached to the fireplace damper. The lower end portion of the rod rests in the housing to co-act with a pair of bimetallic/thermostatic metal strips which flex to regulate movement of the rod and therefore, the damper.

U.S. Pat. No. 4,235,219 to DeFoe, discloses an apparatus for damping fireplace flues which consists of a controller connected to a conventional damper by a suitable linkage. A temperature sensor element and latches co-act to actuate the linkage to open and close the damper.

U.S. Pat. No. 4,554,863 to Dalsin, discloses a chimney damper mounted to the top portion of the chimney flue and which includes a frame which extends above the flue opening and from which an extension spring depends to a flue cover to seal the top of the flue. The cover plate is connected to a stem which is operatively linked by a cable to a control device remotely mounted within the fireplace opening to pull the plate downwardly to cover the flue and to release the spring return to open the flue cover. The control device can be held at a select position depending upon the extent to which the damper is to be opened.

U.S. Pat. No. 4,649,808 to Ward, et al., discloses a fireplace damper assembly adapted to seal a vertical fireplace flue. The damper can be electrically actuated or automatically controlled by actuation of temperature and/or smoke detectors. A fan to provide for a draft and a wind protection hood for the top of the chimney are also disclosed. Thermocouples are installed in the firebox to sense fireplace temperature and in the control box to sense ambient temperature. A control automatically raises the external damper to permit the gases to be expelled through the flue. The damper is automatically closed when the temperature difference returns to low and/or the smoke diminishes. A motor is affixed to the roof and rotates a pulley to raise and lower a cable attached to the damper to be raised and lowered over the top of the flue.

U.S. Pat. No. 4,858,517 to Coker, discloses a fire damper kit for a flue which includes in combination a spring bias door maintained in a first opened position by means of a fusible link that is retracted to a closed second position upon destruction of the fusible link by fire within the damper duct work. A first collar is fixedly secured to the damper with a second collar slidable thereon to sandwich a firewall therebetween and secure the damper thereto.

None of the foregoing patents disclose a combination damper and chimney cap apparatus which is constructed to be removably mountable to a chimney or chimney cap to automatically regulate the draft between a fireplace and a chimney flue.

None of the foregoing patents disclose a combination damper and chimney cap apparatus which includes a support means specifically adapted to support all necessary elements to control the draft through the flue so that the apparatus can be removably mounted to a chimney or chimney cap as a single unit.

OBJECTS AND SUMMARY OF THE INVENTION

An object of the present invention is to provide a combination damper and chimney cap apparatus which is removably mountable to a chimney flue or chimney cap to control the draft therethrough.

It is another object of the present invention to provide a damper apparatus having means to sense heat and/or smoke in the flue and an area external to a fireplace to actuate the damper apparatus to provide a draft from the fireplace through the flue.

It is still another object of the present invention to provide a damper apparatus that provides a draft through the flue sufficient to support combustion and cool elements of the apparatus.

It is still another object of the present invention to provide a damper apparatus which can be actuated electronically and wirelessly.

It is yet another object of the present invention to provide a damper apparatus which is easy to removably mount to a fireplace exhaust, chimney, or chimney cap, is safe and easy to operate.

Accordingly, a damper apparatus for a flue of a chimney is provided which consists of a support means having a sidewall constructed and arranged to be removably mounted to the chimney and to define an aperture which extends through the support means for communication with the flue of the chimney, and regulating means mounted to the support means to regulate the flow of a draft through the aperture and the flue. A drive means is mounted to the support means and coupled to the regulating means to move the regulating means to a position with respect to the aperture and a ventilation means is provided which is associated with the support means and disposed to displace air near the aperture and to ventilate the drive means.

BRIEF DESCRIPTION OF THE DRAWINGS

For a more complete understanding of the present invention, reference may be had to the following description of an exemplary embodiment of the present invention considered in connection with the accompanying drawings, in which.

DETAILED DESCRIPTION OF THE DRAWINGS

Figure 1:
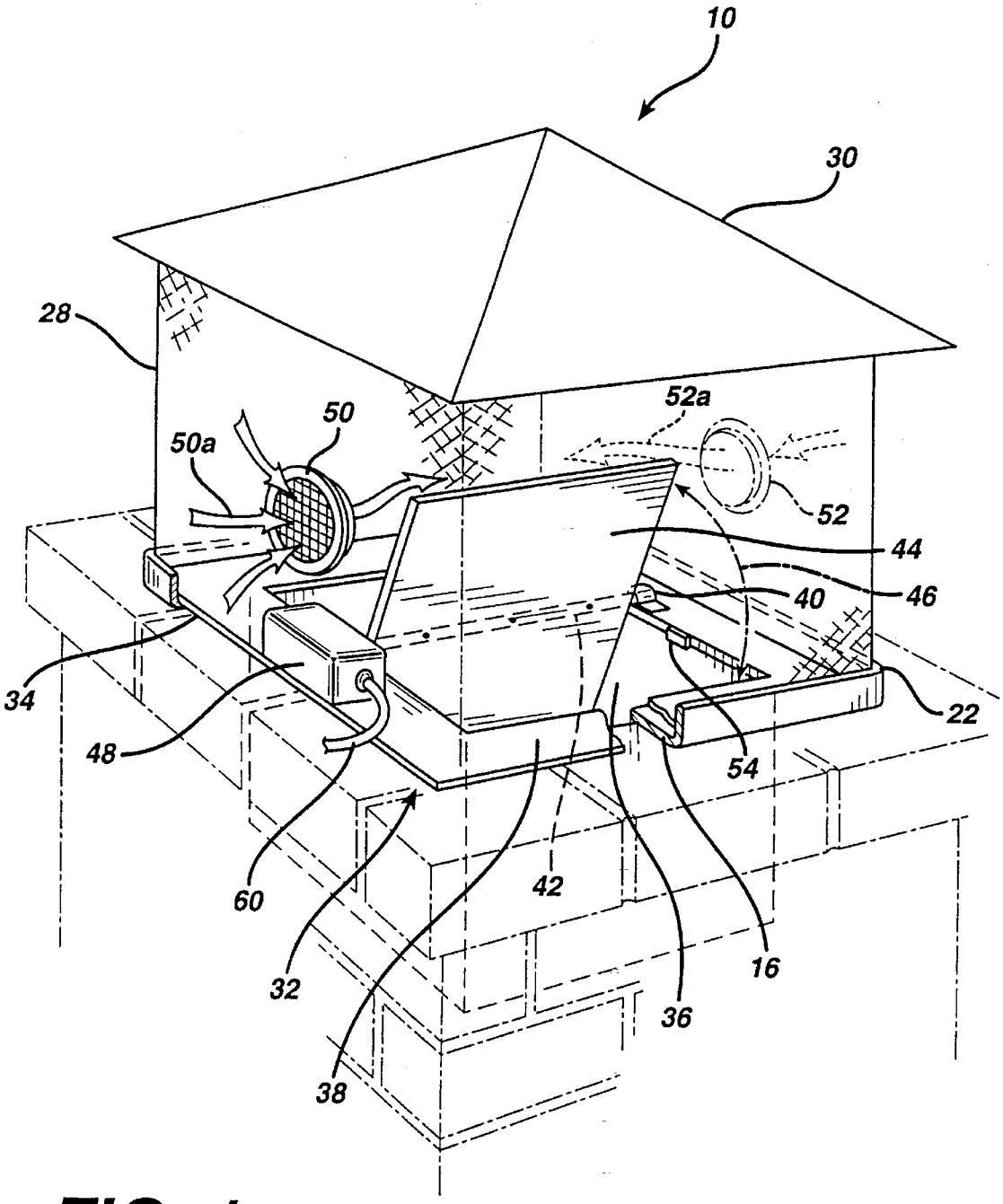
FIG. 1 is a perspective view of a preferred embodiment of a combined damper and chimney cap apparatus according to the present invention removably mounted to a chimney cap at a flue of a chimney to control the draft therethrough.
Figure 2:
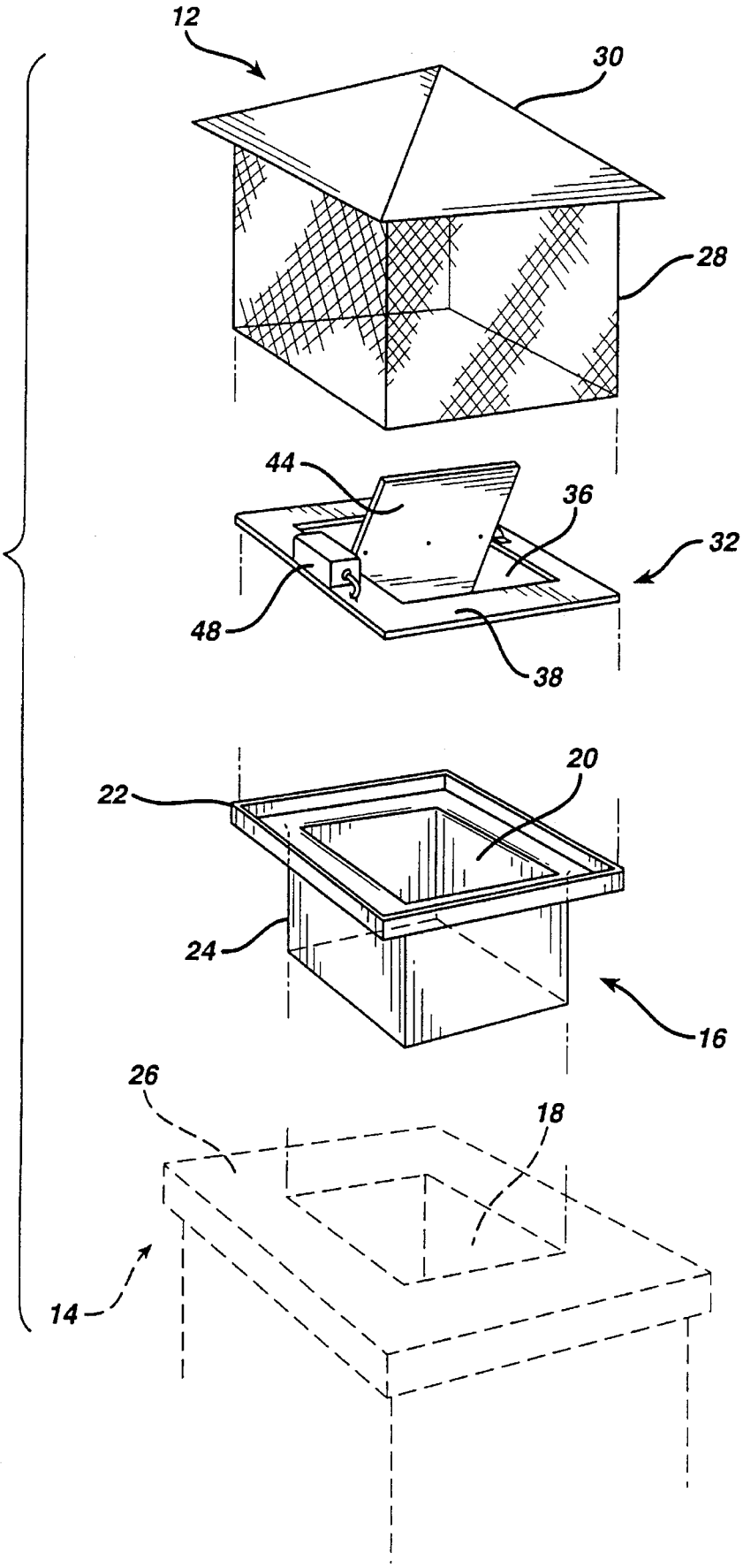
FIG. 2 is an exploded perspective view of chimney cap elements to which the apparatus of the present invention can be removably mounted.

Referring to FIGS. 1 and 2, the combination damper and chimney cap apparatus 10 of the present invention is shown removably mounted to a chimney cap 12 which is depicted in an exploded view to show the corresponding mounting of the chimney cap to a chimney 14. A description of the chimney cap 12 immediately follows to provide for a better understanding of the apparatus 10.

The chimney cap 12 consists of a sleeve portion 16 with sidewalls sized and shaped to be received in a flue 18 for the chimney 14 at the top thereof. The sidewalls of the sleeve 16 define an opening 20 therebetween which extends through the sleeve portion 16 and is in communication with the flue 18. A flange 22 connected to an upper edge of the sidewall radiates outward. A peripheral edge of the flange is provided with a upstanding sidewall. The flange 22 and the sidewall 24 coact to support the damper apparatus 10 and other elements of the chimney cap 12. The flange 22 rests on an upper surface 26 of the chimney 14. A spark screen 28 is received at the flange 22, and a cover 30 is attached to the top of the spark screen to substantially reduce if not eliminate rain and animals from entering the flue 18. The spark screen 28 also breaks up embers escaping from the flue 18.

By way of example, the damper apparatus 10 of the present invention is shown removably mounted to the spark screen However, the damper apparatus 10 can also be removably mounted to the flange 22 or sidewall 24, or directly removably mounted to the chimney 14 at the flue 18.

The damper apparatus 10 includes a platform 32 with a sidewall 34 constructed and arranged to be removably mounted to the chimney cap 12 or the chimney 14. The platform 32 supports the elements of the damper apparatus 10 as described hereinafter, and is preferably rectangularly shaped, although other shapes can be employed to conform to the shape of the flange 22 or the shape of the flue 18. The platform 32 is fabricated from material capable of withstanding the extreme temperatures and other conditions associated with residential and commercial fireplace units, and to tolerate the expansion and contraction associated with extreme temperature variations. Where the platform 32 is removably mounted to the spark screen 28, only removal of the spark screen 28 is necessary to effect maintenance and repair of the damper apparatus 10.

Sidewalls 34 of the platform 32 define an aperture 36 therebetween which extends through the platform 32. The aperture 36 is in communication with the opening 20 of the sleeve 16, and preferably is in registration with the opening 20 and the flue 18.

An upper surface 38 of the platform 32 is provided with a U-shaped bracket 40 or the like at one side of the aperture 36. A shaft 42 extends across the aperture 36 and has an end pivotally mounted to the bracket 40. A longitudinal member 44 functions as a damper to regulate the draft through the flue 18 and the aperture 36 and is connected to the shaft 42. As shown in FIG. 1, the shaft is riveted or spot welded to the damper 44 so that the damper will pivot with the shaft 42 between an open and closed position and any position therebetween as indicated by the arrow 46. The damper 44 is constructed to completely close the aperture 36 when pivoted to the closed position which effectively eliminates the draft through the flue 18. The damper 44 is shown having a rectangular shape although other shapes can be employed for the damper 44 to conform to the shape of and cover the aperture 36.

Alternatively, the shaft 42 can be connected to the damper 44 near a peripheral edge of the damper 44, as opposed to the middle of the damper as shown in FIG. 1, to open and close the aperture 36.

An opposite end of the shaft 42 is coupled to a drive means 48 such as an electric motor. The motor 48 moves the damper 44 via the shaft 42 to any position between the open and closed position indicated by the arrow 46. The motor 48 is supported on and attached to the platform 32.

The damper apparatus 10 also includes ventilation means 50 such as a fan to start and regulate the draft through the flue 18. The fan 50 is preferably mounted to the spark screen 28 above the drive means 48. The exhaust of the fan 50 is preferably directed toward the aperture 36 to draw in air at the exterior of the chimney 14 as represented by arrow 50*a*. The air drawn to the fan 50 will contact and cool the motor 48. The fan 50 displaces the air suspended above the aperture 36 thereby permitting hot air in the flue 18 to rise and be expelled to thereby create the necessary draft for combustion.

A fan 52 can also be mounted to the spark screen 28 at a side of the aperture 36 opposite from the side of the platform 32 where the motor 48 is disposed. The exhaust of the fan 52 is represented by arrow 52*a* and is directed across the aperture 36. The exhaust 52*a* displaces the air suspended above the aperture 36 away from the flue 18 and allows hot air within the flue 18 to rise, thereby creating the draft to promote combustion. The motor 48 is cooled by air drawn into the fan 52 and expelled across the aperture 36 to contact the motor 48.

Figure 3:
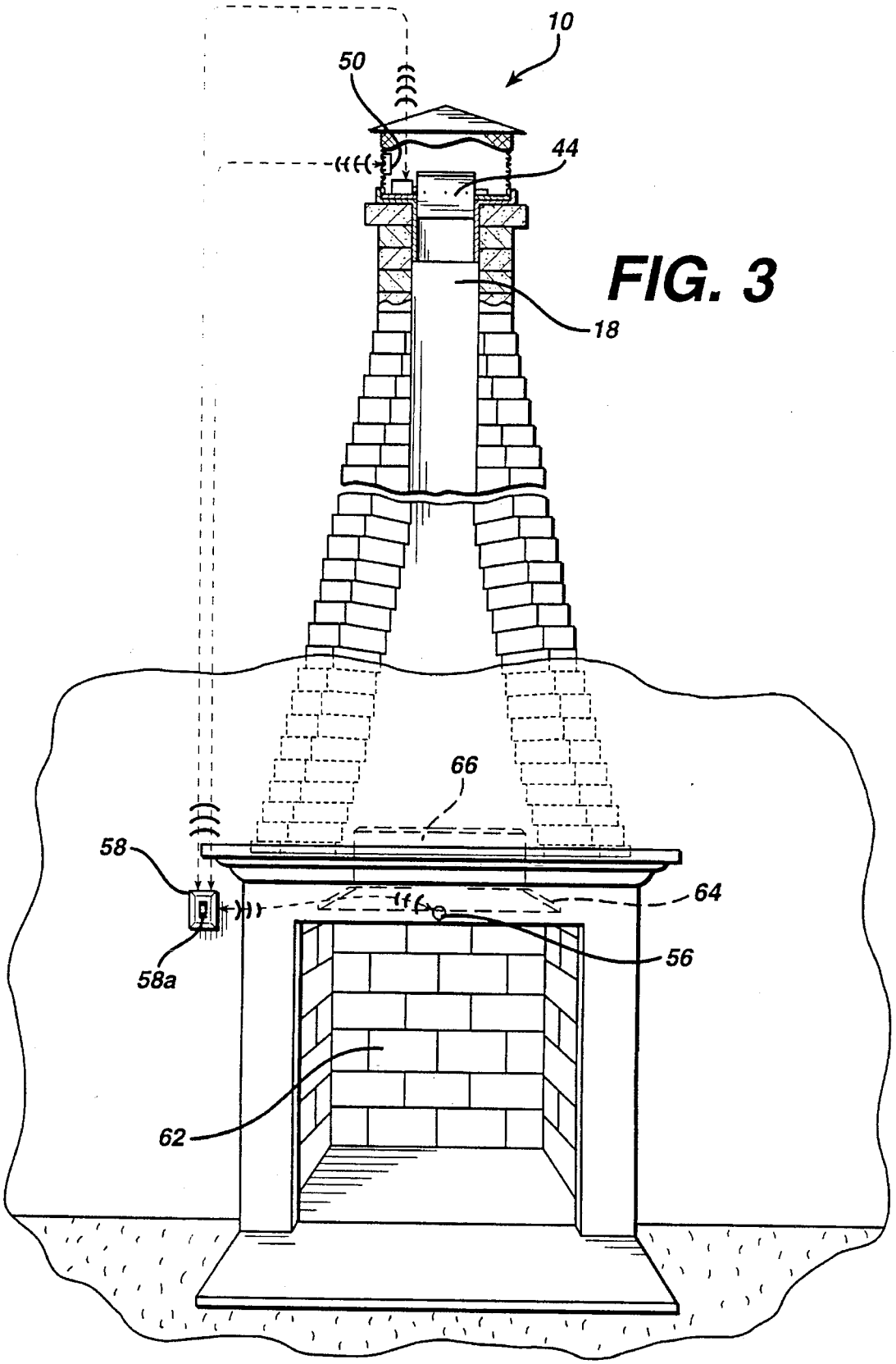
FIG. 3 is an elevational view partially in cross section of the apparatus of the present invention removably mounted to the chimney cap.

Referring to FIG. 3, the damper apparatus further includes control means to actuate the apparatus in response to temperature and/or smoke conditions. The control means includes temperature and/or smoke sensors 54, 56 and a control box 58 all of which are connected by wiring 60 to the control box 58. The control box 58 is shown to include a switching means 58*a* for operating the damper apparatus 10. The control box 58 is typically located within the dwelling and houses switches to power and actuate the motor 48, the fans 50,52 and respond to the sensors 54,56. The control box 58 interconnects the motor 48, fans 50,52 and the sensors 54,56 of the invention to initiate the draft at the flue 18 and to control the same and can operate on an AC or DC power source (not shown). The wiring 60 connecting the motor 48 to the control box 58 is clad or sheathed to protect the wiring from the elements and the heat at the flue 18.

The sensor 54 (FIG.) is attached to the sidewall 34 facing the aperture 36 for exposure to the heat-smoke escaping from the flue 18, and is wired to the control box 58. The sensor 56 (FIG. 3) is positioned near a fireplace 62, preferably exterior to and directly above the fireplace 62, for exposure to escaping smoke and the heat in an area immediately outside of and above the fireplace 62.

The switch 58*a* is operable to actuate the damper apparatus 10 in a plurality of modes. In the first mode, the switch 58*a* is selected to actuate the motor 48 to move the damper 44 from a closed position to an open position to promote the draft for combustion. In another mode, the switch 58*a* is used to actuate the motor 48 to move the damper 44 from a closed position to an open position and to further engage one of the fans 50,52 to provide a draft through the flue 18. In still another mode, the switch 58*a* actuates the motor 48 to move the damper 44 from the closed position to the open position, after which the circuitry of the control means 58 will respond to the sensors 54,56 to determine at what position along the arc represented by the arrow 46 the damper 44 is to be moved and for how long the damper 44 is to be so positioned. The central means 58 will actuate one of the fans 50,52 if necessary. In yet another mode, the switch is merely turned to the automatic setting which will immediately actuate the motor to move the damper 44 from a closed position to a position along the arc represented by the arrow 46 which is conducive to the draft requirements necessary for combustion to take place. In addition, the automatic setting will actuate the fan 50,52 being used if necessary, to insure that the necessary draft is being effected as combustion accelerates and the need to exhaust the heat and smoke increases.

The control means 58 is provided with a reserve power source, such as battery power, for those instances where electrical power has been disrupted. The control means 58 can be actuated wirelessly by a hand remote. The wireless signal to the control means 58 is further transmitted wirelessly to actuate the motor 48 thereby obviating the need for these elements of the damper apparatus 10 to be wired together.

The preferred embodiment of the combination damper and chimney cap apparatus 10 operates as follows. The damper apparatus 10 of the present invention is removably mounted to the chimney cap 12 or the chimney 14 if the cap 12 is not used. The flue 18 dimensions are typically 9"×9", 9"×13", or 13"×13", although other dimensions of the flue 18 can exist. The wiring 60 is led along the outside of the dwelling to the control box 58. In FIG. 3, the control box 58 is wall-mounted.

An existing installed damper, represented by the broken line 64, for the fireplace 62 is moved from a closed position to an open position as represented by the broken line 66. In effect, the function of the damper 64 to seal off the flue 18 is accomplished by the damper apparatus 10 of the present invention which will now serve the dual function of a fireplace damper and a chimney cap. With the damper in the open position as shown at 66 and the apparatus 10 in place, there is no draft between the fireplace 62 and the flue 18.

For manual operation, the user throws the switch 58*a* at the control box 58 to actuate the motor 48 to turn the shaft 42 and pivot the damper 44 from a closed horizontal position to a vertical open position as indicated by the arrow 46. This is usually sufficient to initiate a draft between the fireplace 62 and the flue 18 to promote combustion and effectively draw the smoke and heat from the fire up through the flue 18 to be exhausted from the chimney 14. The fans 50,52 can be further actuated to promote the draft if necessary.

The switch 58*a* can also be moved to the automatic setting. During this operation, the sensor 56 will respond to fire and/or smoke that would initially escape the fireplace 62 without a sufficient draft and rise to an area at an exterior of the fireplace 62. The sensor 56 provides a signal which the control box 58 responds to for actuating the motor 48 to move the damper 44 into the open position to initiate the draft through the flue 18. If necessary, the fan 50 will be actuated to promote the draft so that the smoke and heat are displaced from the flue 18 to further draw more of the same from the fireplace 62 directly up the flue 18.

The sensor 54 provides a signal responsive to the smoke and/or temperature at the aperture 36 of the damper apparatus 10 near the top of the chimney 14. As the fire begins to extinguish, heat and smoke is reduced which is sensed by the sensor 54 and communicated to the control box 58 which will determine the draft to be maintained. Accordingly, the damper 44 is lowered toward the horizontal position to reduce the force of the draft through the flue 18. When the sensor 54 is unable to sense the presence of a predetermined temperature and/or smoke at the aperture 36 at the top of the flue 18, and if such temperature and/or smoke is similarly absent and not detected by the sensor 56 at the fireplace 62, the damper 44 is lowered to the horizontally closed position to "cap" the flue 18 and eliminate the draft altogether. This position of the damper will prevent the heat in the dwelling from escaping through the flue.

If the damper apparatus 10 is manually actuated by the switch 58*a*, as soon as the draft begins, the control box 58 overrides to automatic so that the sensors 54,56 respond to the smoke and/or temperature at the flue 18 and fireplace 62 respectively for the damper apparatus 10 to control the draft.

Activation of the automatic feature of the damper apparatus 10 causes the sensors 54,56 to continuously sense the surrounding temperature and/or smoke levels. If the temperature and/or smoke level exceeds a predetermined amount, the sensors 54,56 signal the control box 58 to actuate the motor 48 to open the damper 44, and actuate the fans 50,52 if necessary, to increase the draft between the fireplace 62 and the flue 18.

Falling temperature and/or smoke levels are sensed by the sensors 54,56 to close the damper 44 an amount sufficient to reduce the draft to a flow required for combustion or the lack thereof. The speed of fans 50,52 is reduced to draw less air through the fireplace and the flue. The draft adjustments occur until the sensors 54,56 detect the temperature and/or smoke to be at a level indicating that combustion is no longer present in the fireplace 62, and that the temperature and smoke level is sufficiently reduced at the aperture 36 for the damper 44 to be moved to the horizontal closed position to cap the flue 18 of the chimney 14.

It is understood that the embodiments described herein are merely exemplary and that a person skilled in the art may make many variations and modifications without departing from the spirit and scope of the invention. All such modifications and variations are intended to be included within the scope of the invention and defined in the appended claims.

What is claimed is:

1. A damper apparatus for a flue of a chimney, comprising:

support means, comprising;

a sidewall constructed and arranged to be removably mounted to the chimney and to define an aperture which extends through the support means for communication with the flue, regulating means mounted to the support means to regulate the flow of a draft through the aperture and the flue;

drive means mounted to the support means and coupled to the regulating means to move the regulating means to a position with respect to the aperture; and ventilating means associated with the support means and disposed external to the aperture of the sidewall to displace air near the aperture to ventilate the drive means.

2. The damper apparatus according to claim 1, further comprising:

sensing means for providing a signal in response to temperature-smoke sensed at the aperture and at a fireplace in communication with the flue; and control means interconnecting the drive means, the ventilating means and the sensing means, the control means responsive to the signal provided by the sensing means for actuating the drive means to move the regulating means to regulate the flow of the draft through the aperture.

3. The damper apparatus according to claim 1, wherein the regulating means is moveable between and including a first position where the regulating means covers the aperture, and a second position where the regulating means does not cover the aperture.

4. The damper apparatus according to claim 3, wherein the regulating means, comprises:

a shaft extending across the support means and having a first end pivotally coupled to the drive means, and a second end pivotally mounted to a bracket at an opposite side of the support means; and a longitudinal member mounted to the shaft for a pivoting movement therewith between the first position, the second position and the positions therebetween.

5. The damper apparatus according to claim 4, wherein the bracket is mounted to the support means at a side of the aperture opposite to a side where the drive means is mounted, the shaft extending across the aperture.

6. The damper apparatus according to claim 4, wherein the longitudinal member is a plate.

7. The damper apparatus according to claim 1, wherein the drive means is an electric motor.

8. The damper apparatus according to claim 1, wherein the ventilating means comprises:

a fan disposed near the drive means and having an inlet to intake air from an area exterior to the chimney for drawing the air to contact the drive means, and an outlet to provide an exhaust to displace air near the aperture.

9. The damper apparatus according to claim 1, wherein the ventilating means comprises:

a fan disposed at a side of the support means opposite to that of the drive means for providing an exhaust to displace air near the aperture and to ventilate the drive means.

10. The damper apparatus according to claim 2, wherein the sensing means comprises:

a first sensor mounted to the support means to face the aperture, and a second sensor mounted to the exterior of the fireplace, wherein the first sensor and the second sensor are connected to the control means for providing the signal of the temperature-smoke sensed at the aperture and the fireplace.

11. The damper apparatus according to claim 2, wherein the signal provided by the sensing means is a wireless transmission, and the control means interconnects the drive means, the ventilating means and the sensing means by wireless signals.

12. A damper apparatus to regulate a draft through a fireplace and a chimney flue connected thereto, comprising:

support means, comprising;

a sidewall constructed and arranged to be removably mounted to the chimney and to define an aperture which extends through the support means for communication with the flue;

regulating means mounted to the support means to regulate the flow of the draft through the aperture and the flue, the regulating means comprising:

a shaft pivotally mounted to the support means, the shaft having opposed ends and a portion intermediate the opposed ends which extends across the support means, a plate-like member mounted to the shaft for pivoting movement therewith between a first position where the plate-like member covers the aperture, and a second position where the plate-like member uncovers the aperture;

drive means, comprising:

an electric motor mounted to the support means and coupled to one of the opposed ends of the shaft to provide pivotal movement to the shaft;

ventilating means associated with the support means and disposed external to the aperture of the sidewall to displace air near the aperture to ventilate the electric motor;

sensing means for providing a signal in response to temperature-smoke sensed at the aperture and the fireplace; and control means interconnecting the drive means, the ventilating means and the sensing means, the control means responsive to the signal provided by the sensing means for actuating the drive means and the ventilating means to regulate the flow of the draft through the aperture.

13. The damper apparatus according to claim 12, wherein the ventilating means comprises:

a fan disposed near the drive means and having an inlet to intake air from an area exterior to the chimney for drawing the air to contact the drive means, and an outlet to provide an exhaust to displace air near the aperture.

14. The damper apparatus according to claim 12, wherein the ventilating means comprises:

a fan disposed at a side of the support means opposite to that of the drive means for providing an exhaust to displace air near the aperture and to ventilate the drive means.

15. The damper apparatus according to claim 12, wherein the sensing means comprises:

a first sensor mounted to the support means for exposure to the draft at the aperture, and a second sensor mounted near an exterior of the fireplace for exposure to the surrounding air, wherein the first sensor and the second sensor are connected to the control means for providing the signal of the temperature-smoke sensed at the aperture and the fireplace.

16. The damper apparatus according to claim 12, wherein the signal provided by the sensing means is a wireless transmission, and the control means interconnects the drive means, the ventilating means and the sensing means by wireless signals.

* * * * *